United States Patent [19]

Lampka et al.

[11] 4,198,171

[45] Apr. 15, 1980

[54] TOOTH-BRUSH ARRANGEMENT

[76] Inventors: Bruno Lampka; Hildegard Lampka, both of Steinbichel 3, D-8960 Kempten, Fed. Rep. of Germany

[21] Appl. No.: 958,957

[22] Filed: Nov. 7, 1978

[30] Foreign Application Priority Data

Dec. 28, 1977 [DE] Fed. Rep. of Germany ..... 2758457

[51] Int. Cl.[2] ..... A46B 17/04; A46B 11/00

[52] U.S. Cl. ..... 401/269; 15/104.93; 15/184; 206/229; 206/362.2; 206/613; 206/634; 401/290

[58] Field of Search ..... 15/104.92, 104.93, 104.94, 15/184; 206/361, 362.2, 229, 633, 634, 613, 625, 626; 128/272; 401/156, 183–186, 269, 270–273, 278, 279, 282, 284, 285, 288, 290, 291

[56] References Cited

U.S. PATENT DOCUMENTS

| | | | |
|---|---|---|---|
| 1,317,437 | 9/1919 | Drury | 401/175 |
| 1,947,720 | 2/1934 | Laub | 401/7 |
| 1,947,721 | 2/1934 | Laub | 401/183 |
| 2,090,144 | 8/1937 | Palimeri | 401/156 |
| 2,159,914 | 5/1939 | Tweedale | 15/104.94 |
| 2,677,842 | 5/1954 | Sherwin | 206/229 |
| 2,932,044 | 4/1960 | Woodrow | 15/104.94 |
| 3,070,102 | 12/1962 | MacDonald | 15/104.94 |
| 3,176,338 | 4/1965 | Homburger | 401/7 |
| 3,288,280 | 11/1966 | Bostrom | 206/633 |
| 3,759,375 | 9/1973 | Nappi | 206/361 |

FOREIGN PATENT DOCUMENTS

| | | | |
|---|---|---|---|
| 975911 | 10/1975 | Canada | 401/185 |

*Primary Examiner*—Clyde I. Coughenour
*Attorney, Agent, or Firm*—Haseltine, Lake & Waters

[57] ABSTRACT

In a vat-like receptacle of plastic material air-tightly closed by a draw-off-strip a bristle head and a predetermined quantity of tooth-paste are provided. After opening the receptacle the bristle head can be fastened at a handle and the tooth-brush is ready for use provided with the necessary amount of tooth-paste in the region of the bristles. The bristle head is a throw-away article.

4 Claims, 6 Drawing Figures

TOOTH-BRUSH ARRANGEMENT

This invention relates to an arrangement for care of one's teeth in form of a tooth-brush the bristle head and the handle of which being detachably fastened.

The invention consists in that the bristle head to be detachably fastened on a separate handle and a predetermined amount of liquid or pasty dentifrice sufficient for one-time use are placed within an air-tight receptacle.

The receptacle consisting of thin-walled plastic material contains a predetermined amount of tooth-paste filled into the lower portion of the receptacle. The bristle head is provided with a cross-section substantially equal with that of the receptacle so that after inserting the bristle head into the receptacle a tooth-paste chamber is closed by the bristle head the bristles of which dipping in or immersing in the tooth-paste.

Further features of the invention consist in that a plurality of receptacles connected with one another via a break line form a strip and that the receptacle comprises a vat consisting of transparent plastic material and having side walls, front and back walls and a bottom, the vat being tightly closed by a draw-off cover, whereby the cover preferably forms a portion of a film or foil sheet to which the plurality of receptacles are attached.

This invention is highly advantageous. The bristle head is provided for one-time use and forms a throw-away element. The bristles can be made of a lower cost material than usual tooth-brushes. However they are highly effective because they are used one time only. The handling is simple. The receptacle only must be opened by pulling off the cover before the handle can be fastened by inserting it into the bristle head. The tooth-brush then is ready for use. It already contains the necessary amount of tooth-paste. After use the bristle head is detached from the handle and can be thrown away together with the empty receptacle.

In the drawings which show an example the invention is described in detail.

Figure 1:
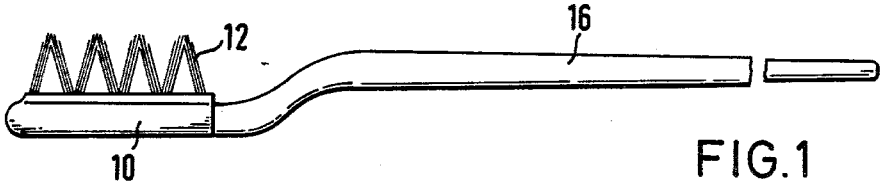
FIG. 1 shows a side view of a tooth-brush consisting of a bristle head and a handle.
Figure 2:
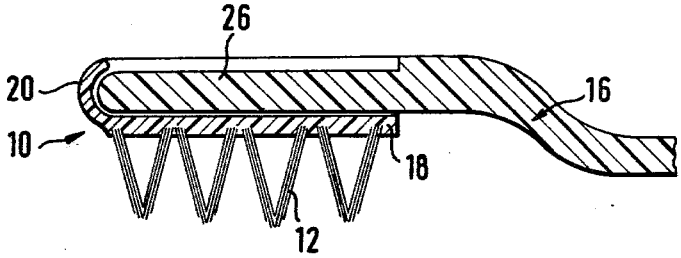
FIG. 2 shows a longitudinal section view of the bristle head in greater detail.

A plurality of bristles 12 arranged in V-shape are fastened at a bristle head 10. The bristle head is provided with an inserting opening 14 at its back side. A handle 16 can be detachably inserted into the opening.

The bristle head 10 is a one-piece plastic body and consists of a bottom 18 from which the bristles protrude, a front wall 20 and a pair of side walls 22, 24. The side walls 22, 24 have C-shaped cross-sections respectively and are arranged in mirror image shape such that a slide guide is formed for an inserting portion 26 of the handle 16.

The bristle head is placed in a receptacle 28 consisting of a vat 30 and a draw-off cover 32. The vat 30 consists of thin-walled transparent plastic material. It tapers downwardly between the pair of side walls and also between the front and rear walls. The lower portion of the vat forms a chamber containing a predetermined amount of liquid or pasty toothpaste 34. This amount is sufficient for a one-time tooth brushing.

Figure 3:
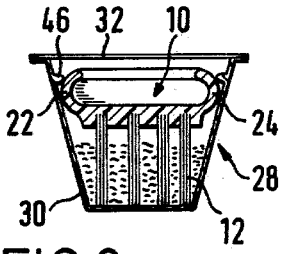
FIG. 3 shows a cross-section view of a tightly sealed receptacle containing the combination of a bristle head and a predetermined amount of tooth-paste.
Figure 4:
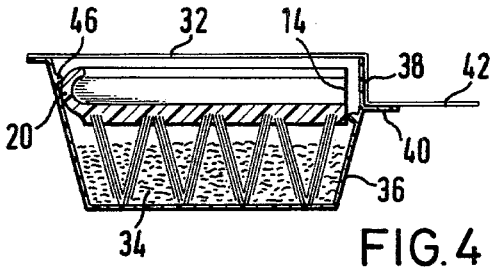
FIG. 4 shows a longitudinal section view of the receptacle according to FIG. 3.

As can be seen in FIG. 3 and FIG. 4 the side walls and the front wall of the vat 30 are of greater height than the back wall 36 the height of which is only substantially equal with the height of the bristles. Therefore with respect to the vat height the height of the back wall 36 is reduced by the thickness or height of the body of the bristle head 10. The draw-off cover 32 is provided with a back wall portion 38 extending substantially perpendicularly to the cover and downwardly to the upper edge of the back wall 36 of the vat. This back wall 36 is connected with an outwardly extending flange 40. The back wall portion 38 has a flap 42 in parallel relationship with the flange 40 and extending beyond that flange thus forming a draw-off tongue. Cover, back wall portion and flap form a Z-shaped element.

The cover is tightly connected with the vat preferably by heat sealing and the back wall portion 38 is heat-sealed with the side walls of the vat.

Figure 5:
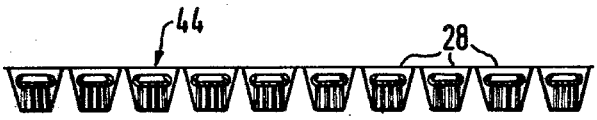
FIG. 5 shows a side view of a package consisting of a plurality of receptacles connected with one another.
Figure 6:
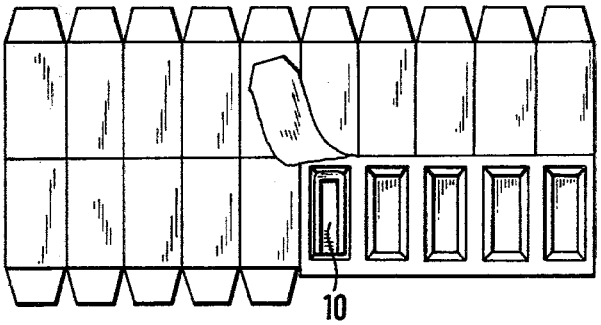
FIG. 6 shows a plan view of a two-row package, in which some receptacles have been opened.

The projecting end of the flap 42 can be gripped between two fingers of the user and lifted to draw-off the flap 42 from the flange 40, to move the back wall portion 38 upwardly and to separate the cover 32 from the vat. The back side inserting opening 14 of the bristle head 10 is uncovered and the inserting portion 26 of the handle 16 can be inserted into the opening 14 in order to remove the bristle head 10 from the vat together with tooth paste contained in the region of the bristles. After use the bristle head is drawn-off from the handle and thrown away. FIG. 5 and FIG. 6 show a package strip 44 consisting of a plurality of receptacles 28 connected with one another by circum-ferentially extending upper flanges of the vat and/or by a cover sheet to which the receptacles are attached by heat-sealing. Between each two receptacles break lines are formed in the cover sheet and/or in the pair of upper flanges of adjacent vats in order to separate one receptacle or vat from the package strip.

FIG. 6 shows four empty vats. The fifth vat is being opened by drawing-off the cover and the bristle head becomes visiable.

The receptacle 28 has such dimensions with respect to the bristle head 10 that the latter circum-ferentially contacts the inner surfaces of the side walls, front and back walls of the vat. This is important to seal or at least tightly limit a tooth-paste chamber inside the receptacle in order to avoid tooth-paste flowing into the upper region of the receptacle and especially into the interior of the bristle head 10. This object is further contributed by an inner seam 46 circumferentially extending at the side walls, front wall and back wall of the vat co-operating with the respective outer surfaces of the bristle head 10.

What we claim is:

1. In a tooth-brush arrangement comprising, a bristle head, said bristle head is detachably fastened to a separate handle; a receptacle containing a predetermined amount of liquid or pasty dentifrice substance sufficient for one-time use; a plurality of bristles fastened at the bristle head, said bristles on said head are immersed in said dentifrice substance; the receptacle being formed of plastic material and defined by, respectively, a bottom, front, back and side walls the walls extend from the bottom to form a cross-section substantially equal with that of the bristle head which is in circumferential contact with said side walls; the front and back walls respectively of the receptacle tightly limiting a tooth-paste chamber inside said receptacle, the improvement comprises: an extension portion of the side walls and the front walls of the receptacle, said extension portion is beyond said circumferential contact with the bristle head, whereby the upper edges of the front wall and the side walls are spaced from the bottom a distance substantially equal with the overall height of the bristle head including the bristles, and the height of the back wall is substantially equal to the height of the bristles alone, to leave an opening for insertion of the handle; a draw-off cover tightly connected with the upper edges of the receptacle; said cover is provided with a substantially rectangularly bent-off wall portion extending downwardly to the upper edge of the back wall of the receptacle and closing said opening; and said wall portion of the cover is tightly connected with the side walls and the back wall respectively of the receptacle.

2. A tooth-brush arrangement as claimed in claim 1, wherein: the bent-off wall portion of the cover ends in a flap substantially parallel to the cover and is connected with a flange provided at the upper edge of the back wall of the receptacle.

3. A tooth-brush arrangement as claimed in claim 1, wherein: the respective walls of the receptacle are provided with tightening beads arranged at the inner surfaces of the walls, contacting the bristle head.

4. A tooth-brush arrangement as claimed in claim 1, wherein: the cover forms a portion of a film sheet, to which a plurality of receptacles are attached, the film sheet being provided with break lines.

* * * * *